US011459900B2

(12) United States Patent
Takagi et al.

(10) Patent No.: US 11,459,900 B2
(45) Date of Patent: Oct. 4, 2022

(54) TURBINE STATOR BLADE

(71) Applicant: TOSHIBA ENERGY SYSTEMS & SOLUTIONS CORPORATION, Kawasaki (JP)

(72) Inventors: Norikazu Takagi, Kawasaki Kanagawa (JP); Tsuguhisa Tashima, Yokohama Kanagawa (JP); Daisuke Nomura, Kawasaki Kanagawa (JP); Yoshifumi Iwasaki, Yokohama Kanagawa (JP); Shogo Iwai, Ota Tokyo (JP); Takahiro Ono, Ota Tokyo (JP)

(73) Assignee: TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 0 days.

(21) Appl. No.: 17/343,206

(22) Filed: Jun. 9, 2021

(65) Prior Publication Data

US 2021/0388731 A1 Dec. 16, 2021

(30) Foreign Application Priority Data

Jun. 16, 2020 (JP) ..... JP2020-103654

(51) Int. Cl.
*F01D 9/04* (2006.01)
*F01D 9/02* (2006.01)
(Continued)

(52) U.S. Cl.
CPC ..... *F01D 9/041* (2013.01); *F01D 9/02* (2013.01); *F01D 9/04* (2013.01); *F01D 11/006* (2013.01);
(Continued)

(58) Field of Classification Search
CPC ..... F01D 25/246; F01D 11/006; F01D 9/02; F01D 9/04; F01D 9/041; F01D 11/005;
(Continued)

(56) References Cited

U.S. PATENT DOCUMENTS 3,781,125 A * 12/1973 Rahaim ..... F01D 9/042 415/115
5,271,714 A * 12/1993 Shepherd ..... F01D 25/246 415/189
(Continued)

FOREIGN PATENT DOCUMENTS

EP 1 793 088 A2 6/2007
EP 3 244 020 A2 11/2017
(Continued)

OTHER PUBLICATIONS

Inconel 600 Material Data, Publication No. SMC-027 Copyright © Special Metals Corporation, 2008 (Sep. 8, 2008).*
(Continued)

*Primary Examiner* — Igor Kershteyn
*Assistant Examiner* — Brian Christopher Delrue
(74) *Attorney, Agent, or Firm* — Foley & Lardner LLP

(57) ABSTRACT

According to an embodiment, a turbine stator blade disposed in a working fluid flow path in a casing of a gas turbine, includes: a blade effective part disposed in the working fluid flow path; an outer circumferential sidewall having a plate-shaped part that is connected to a radially outer end portion of the blade effective part, and hooks each extending radially outward and circumferentially from the plate-shaped part and having a tip engaged with the casing; and an inner circumferential sidewall connected to a radially inner end portion of the blade effective part. At least one slit is formed
(Continued)

at the rear hook or front hook to divide the hook in a circumferential direction, and the hook has a seal member to seal the slit.

6 Claims, 11 Drawing Sheets

(51) Int. Cl.
*F01D 11/00* (2006.01)
*F01D 25/24* (2006.01)

(52) U.S. Cl.
CPC ..... *F01D 25/246* (2013.01); *F05D 2220/32* (2013.01); *F05D 2240/12* (2013.01)

(58) Field of Classification Search
CPC ..... F05D 2220/32; F05D 2240/12; F05D 2240/57; F05D 2260/941
See application file for complete search history.

(56) References Cited

U.S. PATENT DOCUMENTS 5,762,472 A * 6/1998 Pizzi ..... F01D 11/08 415/173.1
7,229,245 B2 * 6/2007 Ellis ..... F01D 9/041 415/138
10,844,723 B2 * 11/2020 Song ..... F01D 9/04
2005/0179215 A1 * 8/2005 Kono ..... F16J 15/0887 277/628
2007/0122275 A1 5/2007 Busch et al.
2009/0169376 A1 * 7/2009 Morgan ..... F02C 7/28 29/402.02
2009/0246014 A1 * 10/2009 Shapiro ..... F01D 9/042 415/208.1
2013/0189092 A1 * 7/2013 Dube ..... F01D 11/001 415/200
2016/0003077 A1 1/2016 Banks et al.
2016/0047259 A1 2/2016 Banks et al.
2017/0321560 A1 11/2017 Balawajder et al.
2017/0370240 A1 * 12/2017 Sippel ..... F01D 5/225
2019/0120070 A1 4/2019 Tsuruta et al.
2020/0024952 A1 * 1/2020 Song ..... F01D 9/04

FOREIGN PATENT DOCUMENTS

FR 2929983 A1 10/2009
GB 2 462 268 A 2/2010
WO WO-2014/151299 A1 9/2014
WO WO-2014/169193 A1 10/2014
WO WO-2017/158637 A1 9/2017

OTHER PUBLICATIONS

Inconel 718 Material Data, Publication No. SMC-045 Copyright © Special Metals Corporation, 2007 (Sep. 7, 2007).*

* cited by examiner

TURBINE STATOR BLADE

CROSS-REFERENCE TO RELATED APPLICATION

This application is based upon and claims the benefit of priority from Japanese Patent Application No.2020-103654 filed on Jun. 16, 2020, the entire content of which is incorporated herein by reference.

FIELD

Embodiments of the present invention relate to a turbine stator blade used for a gas turbine.

BACKGROUND

In recent gas turbines, due to high temperature of working fluid, cooling medium is supplied to hollow portions of rotor blades and stator blades, which have a hollow cooling structure fabricated by precision casting. This prevents temperature rise due to heat transfer from the working fluid.

In the case of stator blades of a gas turbine, the stator blades, which are each formed by one or a plurality of blade effective parts integrated by being sandwiched between an outer circumferential sidewall at radial outside and an inner circumferential sidewall at radial inside, are arranged circumferentially. The stator blade is supported by a casing from the radial outside by a front hook and rear hook protruding radially outward at the outer circumferential sidewall and engaged with the casing.

The cooling medium is introduced from the casing side to the blade effective part through the outer circumferential sidewall. Therefore, a cooling medium space is formed circumferentially between the front hook and rear hook, which serves as a flow path connecting a supply flow path from the casing to the blade effective part of each stator blade.

Here, among gas turbines, a $CO_2$ turbine requires the same cooling structure as a conventional gas turbines because operating temperature is as high as that of the conventional gas turbine, and the rotor blades and stator blades have hollow structure as described above.

On the other hand, an operating pressure of the $CO_2$ turbine is as high as that of a steam turbine, and pressure difference generated at the rotor blades and stator blades, that is, a pressure difference between the cooling medium and the working fluid, or pressure difference between pressure in front and pressure behind the rotor blade, is as much as ten times higher than those of the conventional gas turbine. In the case of the steam turbine, for example, the rotor blades and stator blades are thick-walled and solid and are designed to withstand large pressure differences, but the $CO_2$ turbine cannot take the same approach as the steam turbine because the rotor blades and stator blades are required to have the cooling structure as described above.

Thus, the stator blade of the $CO_2$ turbine is used under high-temperature and high-pressure conditions that are more severe in strength than those of the conventional gas turbine.

The stator blade is attached to the casing with hooks. In the stator blade of the $CO_2$ turbine, wall-thicknesses of a portion of the outer circumferential sidewall, which supports the blade effective part at a radially outer end portion of the blade effective part, and wall-thicknesses of the hook, which extends radially outward at the outer circumferential sidewall and is coupled to a casing hook, are thicker compared to the conventional gas turbine, because they are used under high-pressure conditions as described above. As a result, when comparing stiffness of the blade effective part with that of the outer circumferential sidewall, the stiffness of the outer circumferential sidewall is relatively higher.

In the outer circumferential sidewall, large metal temperature difference is produced between a portion that is exposed to the high-temperature working fluid during operation and a portion such as hook portion that is exposed to the low-temperature cooling medium. Therefore, there has been a problem that when thermally deformed, thermal stress at a root of the blade effective part, that is, a portion attached to the outer circumferential sidewall, becomes high, leading to damage. In solving this problem, to reduce deterioration of turbine performance is another problem

DETAILED DESCRIPTION

An object of this embodiment is to ensure soundness of a turbine stator blade without causing degradation of turbine performance.

According to an aspect of the present invention, there is provided a turbine stator blade disposed in a working fluid flow path in a casing of a gas turbine, the turbine stator blade comprising: a blade effective part disposed in the working fluid flow path; an outer circumferential sidewall including a plate-shaped part that is connected to a radially outer end portion of the blade effective part, and hooks each extending radially outward and circumferentially from the plate-shaped part and having a tip engaged with the casing; and an inner circumferential sidewall connected to a radially inner end portion of the blade effective part; wherein at least one slit is formed at the hook to divide the hook in a circumferential direction, and the hook has a seal member to seal the slit.

Hereinafter, a turbine stator blade according to embodiments of the present invention will be explained with reference to the drawings. Here, substantially the same or similar components are denoted by the same reference signs, and a redundant description is sometimes omitted.

First Embodiment

Figure 1:
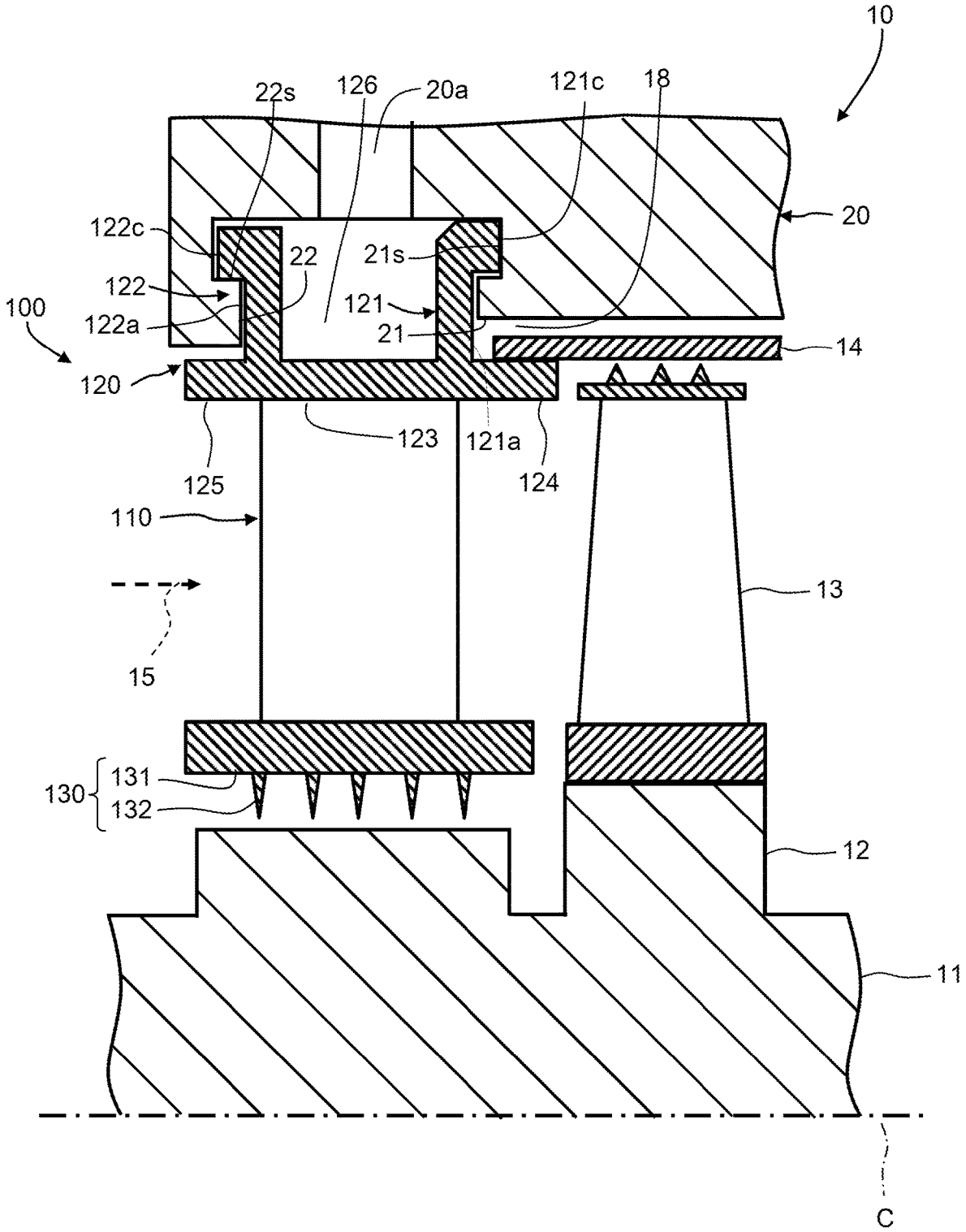
FIG. 1 is a partial sectional view along a shaft center axis of a gas turbine illustrating an attached state of a turbine stator blade according to a first embodiment.

FIG. 1 is a partial sectional view along a shaft center axis C of a gas turbine 10 illustrating an attached state of a turbine stator blade 100 according to a first embodiment. In the following, a configuration around the turbine stator blade 100 in the gas turbine 10 will be mainly explained.

In the following, a direction parallel to the shaft center axis C, which is a rotation axis of a rotor shaft 11, is referred to as an axial direction, and a direction away from the shaft center axis C is referred to as a radial direction. A direction toward or near the rotor shaft 11 in the radial direction is referred to as a radial inside, and a direction away from or farther from the rotor shaft 11 in the radial direction is referred to as a radial outside.

An annular working fluid flow path 15 is formed on the radial outside of the rotor shaft 11 and on the radial inside of a casing 20 of the gas turbine 10, through which a working fluid, which is generated by a non-illustrated combustor and flowing into the gas turbine 10, is flowing. Flow direction of the working fluid in the working fluid flow path 15 is from a left side to a right side in FIG. 1. For convenience of explanation, an upstream side of the working fluid flow may be sometimes referred to as front side and a downstream side as rear side.

Rotor discs 12 are formed on the rotor shaft 11, extend radially outward and are disposed with axial intervals therebetween. A plurality of rotor blades 13 are attached to each of the rotor discs circumferentially and form a rotor blade cascade. Shroud segments 14 are provided circumferentially via gaps at the radial outside of the rotor blades 13 to allow cooling medium to pass between the shroud segments 14 and the casing 20 and to prevent the high-temperature working fluid in the working fluid flow path 15 from touching the casing 20.

Immediately upstream of the rotor blades 13, a plurality of turbine stator blades 100 are disposed circumferentially to form a stator blade cascade. Each turbine stage is formed by each stator blade cascade and its immediately downstream rotor blade cascade. In FIG. 1, only one turbine stage is illustrated.

Each turbine stator blade 100 has a blade effective part 110 that is disposed in the working fluid flow path, an outer circumferential sidewall 120 that is a portion disposed radially outside the blade effective part 110, and an inner circumferential sidewall 130 that is a portion disposed radially inside the blade effective part 110. One or a plurality of blade effective parts 110 are provided between one outer circumferential sidewall 120 and the corresponding inner circumferential sidewall 130. The inner circumferential sidewall 130 has a plate-shaped part 131 that extends axially and extends circumferentially, and a plurality of labyrinth teeth 132 that are formed with axial intervals therebetween to extend circumferentially on a radially inner surface of the plate-shaped part 131. The plurality of labyrinth teeth 132 form a labyrinth with a surface of the rotor shaft 11.

The turbine stator blade 100 is supported by the casing 20 at the outer circumferential sidewall 120. The details are described below.

The outer circumferential sidewall 120 has a plate-shaped part 123, a rear hook 121, and a front hook 122. The plate-shaped part 123 is a portion that is connected to a radially end portion of the blade effective part 110. The rear hook 121 and front hook 122 are formed to extend radially outward on rear and front portions of a radially outer surface of the plate-shaped part 123, respectively. The rear hook 121 and front hook 122 are hereinafter collectively referred to as hooks.

The rear hook 121 has a rear hook wall part 121*a* that is a portion extending radially outward, and a rear hook protruding part 121*c* that is formed to protrude rearward from a radially outer end portion of the rear hook wall part 121*a*.

The front hook 122 has a front hook wall part 122*a* that is a portion extending radially outward, and a front hook protruding part 122*c* that is formed to protrude forward from a radially outer end portion of the front hook wall part 122*a*.

On the other hand, the casing 20 has casing rear hooks 21 and casing front hooks 22 formed circumferentially. The casing rear hook 21 is engageable with the rear hook protruding part 121*c* of the rear hook 121 radially inside and outside each other. The casing front hook 22 is engageable with the front hook protruding part 122*c* of the front hook 122 radially inside and outside each other. As a result, the turbine stator blade 100 is attached to the casing 20 and supported by the casing 20.

The rear hook 121 and the front hook 122 of the outer circumferential sidewall 120 form a cooling medium space 126, in a part between the rear hook 121 and front hook 122, which introduces the cooling medium leading to an inside of the blade effective part 110. As a result, the cooling medium space 126 is formed throughout whole circumferences. At least one cooling medium flow path 20*a* is formed at the casing 20 to lead the cooling medium to this cooling medium space 126.

The first reason for providing the cooling medium space 126 is to reduce thermal effect on the casing 20. That is, the blade effective part 110 of the turbine stator blade 100 is exposed to the high-temperature working fluid. A radially inner surface of the outer circumferential sidewall 120 is in contact with the working fluid, and with the addition of heat conduction from the blade effective part 110, it becomes in a high-temperature state. Although the outer circumferential sidewall 120 is engaged with the casing 20, a material of the casing 20 is generally not such material as those capable of enduring high temperature like a material of the turbine stator blade 100. Therefore, it is necessary to keep the temperature of the casing 20 within an appropriate temperature range.

The second reason for providing the cooling medium space 126 is to secure a supply flow path of the cooling medium to the blade effective part 110. In many gas turbines, the blade effective parts 110 are each hollow and have a cooling medium flow path formed thereinside. This is because a circumferential annular flow path is necessary to supply the cooling medium to each of the turbine stator blades 100 arranged circumferentially.

On front and rear side of the plate-shaped part 123 of the outer circumferential sidewall 120, a rear protruding part 124 is formed as a portion on a rear downstream end side from a connecting portion of the plate-shaped part 123 and the rear hook 121, and a front protruding part 125 is formed as a portion on a front (upstream side) upstream end side a connecting portion of the plate-shaped part 123 and the front hook 122.

The outer circumferential sidewall 120 is formed by integrally casting the plate-shaped part 123, the rear protruding part 124, the front protruding part 125, the rear hook 121, and the front hook 122, for example, and partially finished by machining.

A radially outer surface of the rear protruding part 124 is in close contact with a radially inner surface of the shroud segment 14 disposed on the radial outside of the rotor blade 13, to form a seal portion between an intermediate chamber 18, which is formed between the shroud segment 14 and the casing 20, and the working fluid flow path 15.

In an operating state of the gas turbine 10, the rear hook 121 of the outer circumferential sidewall 120 and the casing rear hook 21 form a seal portion by close-contact between a rear side surface of the rear hook protruding part 121*c* of the rear hook 121 and a rear sealing surface 21*s* that is a rear side surface on the radial outside of the casing rear hook 21. This is mainly because the turbine stator blade 100 is pushed to rear (downstream) side due to pressure difference of the working fluid in front and behind the turbine stator blade 100. This seal portion functions as a seal portion between the cooling medium space 126 and the intermediate chamber 18.

In the operating state of the gas turbine 10, the front hook 122 of the outer circumferential sidewall 120 and the casing front hook 22 form a seal portion by close-contact between a radially inner surface of the front hook protruding part 122*c* of the front hook 122 and a front sealing surface 22*s* that is a radially outer surface of the casing front hook 22. This is mainly because the outer circumferential sidewall 120 is pushed to the radial inside due to a differential pressure between the cooling medium in the cooling medium space 126 and the working fluid in the working fluid flow path 15. This seal portion functions as a seal portion between the cooling medium space 126 and the working fluid flow path 15.

Figure 2:
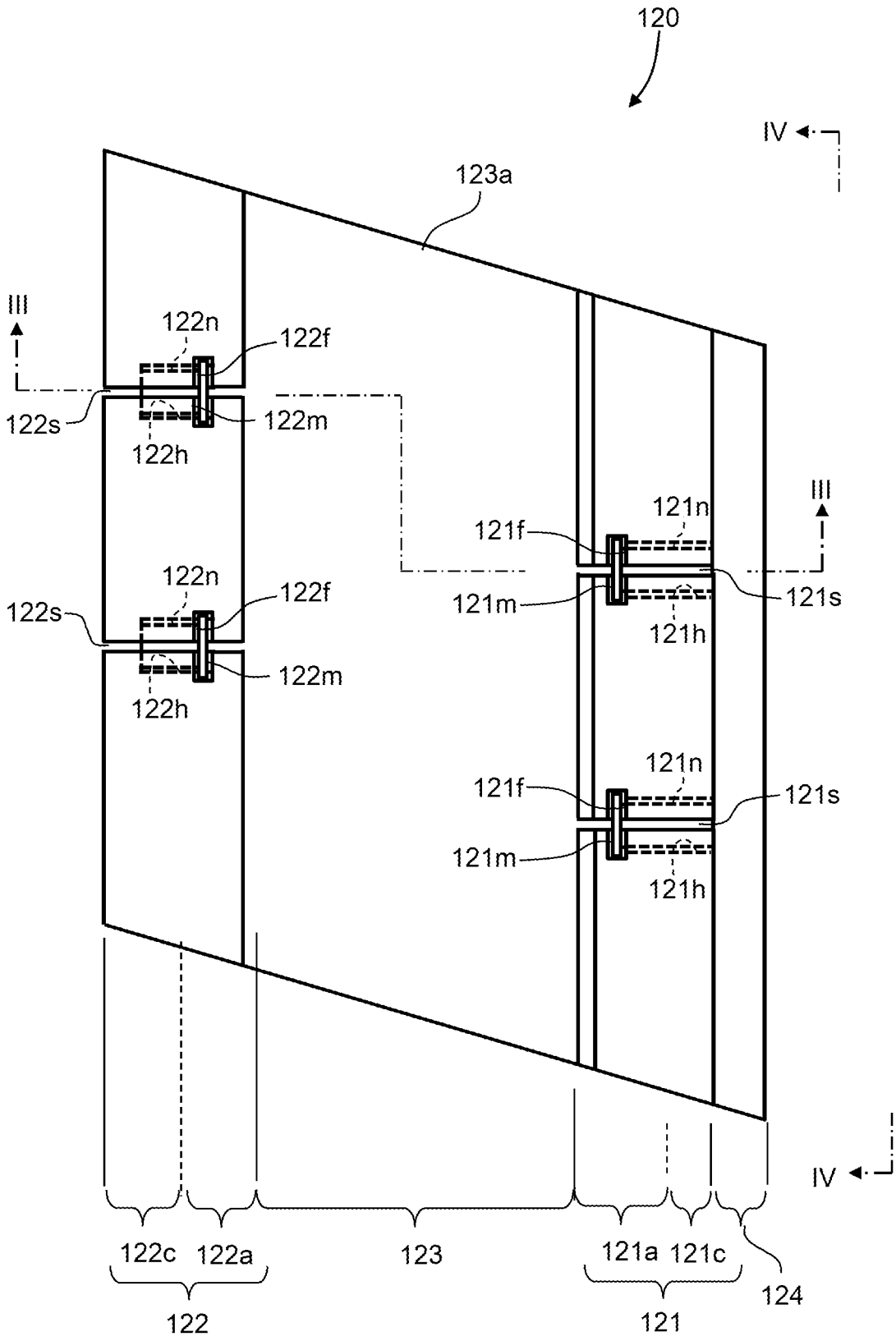
FIG. 2 is a plan view of the turbine stator blade according to the first embodiment, viewed from radial outside.
Figure 3:
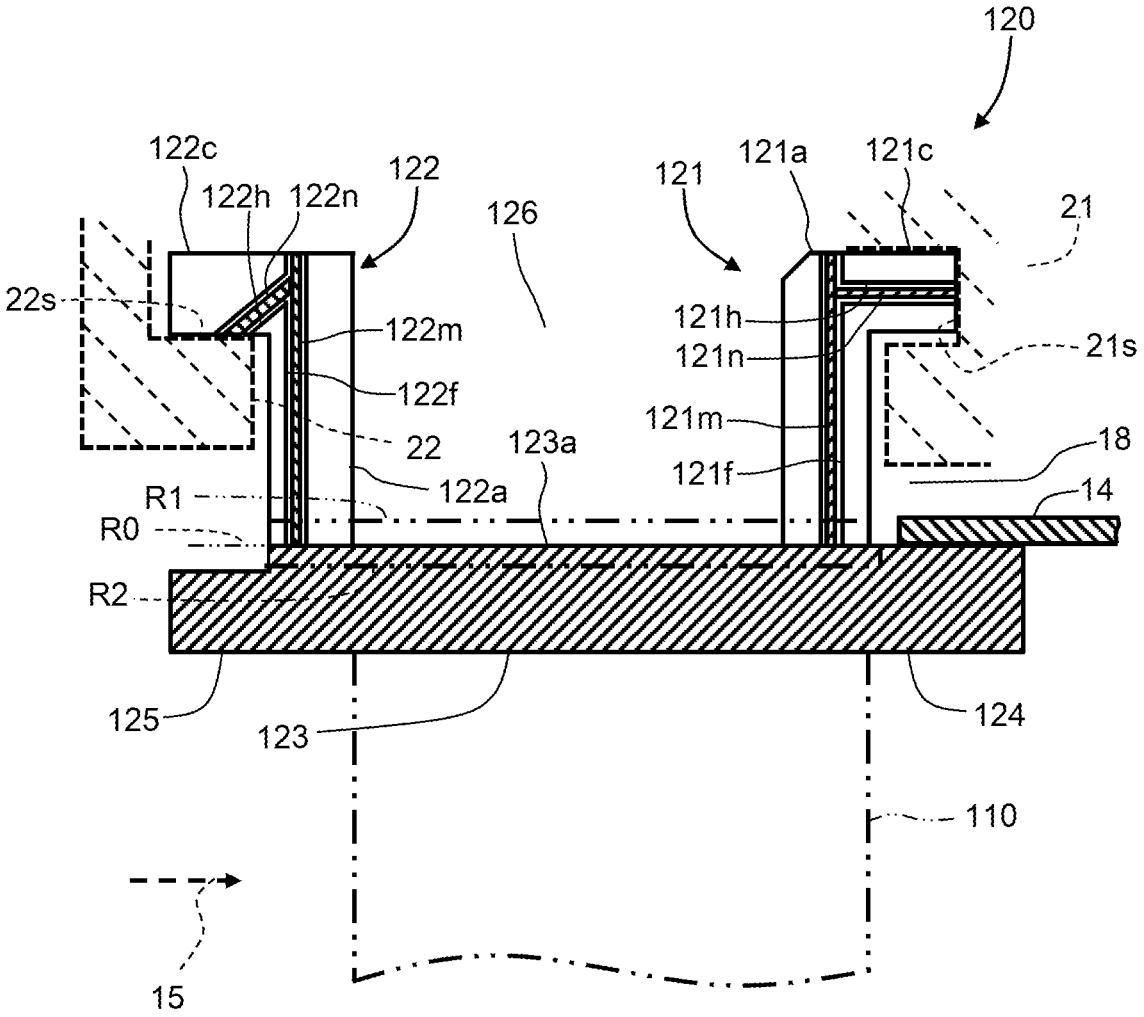
FIG. 3 is a sectional arrow view illustrating the turbine stator blade according to the first embodiment, taken along a line III-III in FIG. 2.
Figure 4:
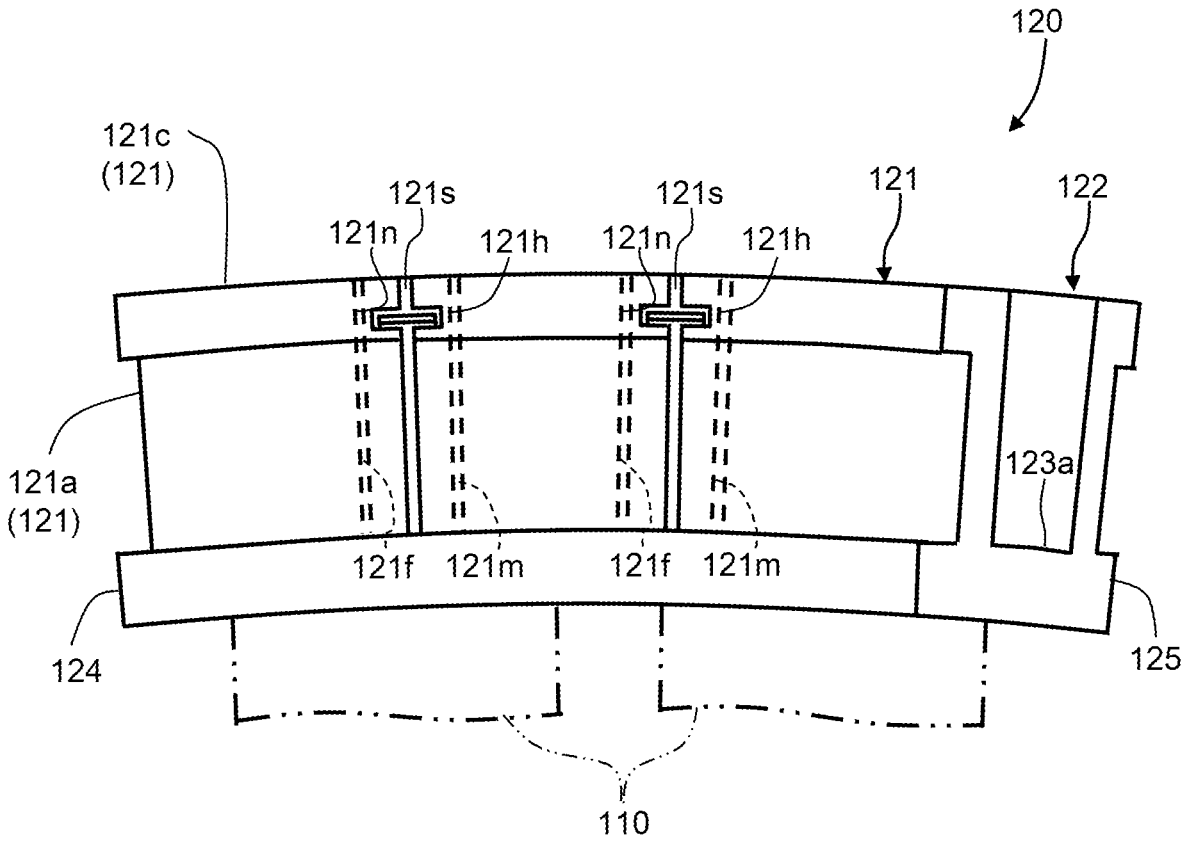
FIG. 4 is a front arrow view illustrating the turbine stator blade according to the first embodiment, taken along a line IV-IV in FIG. 2.

FIG. 2 is a plan view of the turbine stator blade according to the first embodiment, viewed from radial outside, FIG. 3 is a sectional arrow view taken along a line III-III in FIG. 2, and FIG. 4 is a front arrow view taken along a line IV-IV in FIG. 2. A configuration of the outer circumferential sidewall 120, which is a characteristic portion of the turbine stator blade 100 according to the present embodiment, will be mainly explained below using FIG. 2 to FIG. 4.

The outer circumferential sidewall 120 has the aforementioned rear hook 121, front hook 122, and plate-shaped part 123. The plate-shaped part 123 is a connection portion with a radially outer end portion of the blade effective part 110 and extends circumferentially along a concentric circle with the rotor shaft 11 (FIG. 1). The front hook 122 and rear hook 121 each extend radially outward from the radially outer surface of the plate-shaped part 123 and extend circumferentially.

As illustrated in FIG. 3, the rear hook 121 has the rear hook wall part 121*a* that is the portion extending radially outward, and the rear hook protruding part 121*c* formed to protrude rearward from the radially outer end portion of the rear hook wall part 121*a*. As mentioned above, the rear side surface of the rear hook protruding part 121*c* is in close contact with the rear sealing surface 21*s* of the casing rear hook 21 to form the seal portion between the intermediate chamber 18 and the working fluid flow path 15.

The front hook 122 has the front hook wall part 122*a* that is the portion extending radially outward, and the front hook protruding part 122*c* formed to protrude forward from the radially outer end portion of the front hook wall part 122*a* described above. As mentioned above, the radially inner surface of the front hook protruding part 122*c* is in close contact with the front sealing surface 22*s* (FIG. 1) of the casing front hook 22 to form the seal portion between the cooling medium space 126 and the working fluid flow path 15 (FIG. 1).

FIG. 3 illustrates a cross-section at a portion where these seal portions are missing due to formation of slits, which will be described later, and seal members described later are compensating for the defect in the seal portions.

As illustrated in FIG. 2 and FIG. 4, a plurality of slits, described below, are formed at the outer circumferential sidewall 120, and in each of the slits, the seal members, described below, are attached to ensure a sealing function of the seal portion described above. FIG. 3 illustrates the cross-section along the axial direction at the seal portion as described above. That is, area, where the slits are formed, are illustrated by unhatched area.

In the following, the case when there are rear hook slits 121*s* formed at the rear hook 121 and front hook slits 122*s* formed at the front hook as the formed slits is illustrated as an example, but only one of the slits may be formed such as only the rear hook slits 121*s* formed at the rear hook 121, for example, as long as the soundness of the turbine stator blade 100 can be ensured as described later. That is, the slits may be formed at a part of the hook or the entire hook.

The following describes the case of the rear hook 121 and the case of the front hook 122, in turn.

As illustrated in FIG. 2 and FIG. 4, two rear hook slits 121*s* as the slits are formed at the rear hook 121 in the axial direction. The number of rear hook slits 121*s* is not limited to two, but can be one, three, or more.

As illustrated in FIG. 4, the rear hook slits 121*s* are formed along the axial direction to extend radially, but the plurality of rear hook slits 121*s* in one turbine stator blade 100 need not all be formed radially, and for example, may be formed parallel to each other and their centers may locate radially.

A depth in the radial direction of each rear hook slit 121*s* reaches a radial position RO that is the same radial position as a plate-shaped part radially outer surface 123*a* of the plate-shaped part 123, as illustrated in FIG. 3.

As illustrated in FIG. 3, regarding the depth in the radial direction of the rear hook slit 121*s*, a radially innermost portion of the rear hook slit 121*s* may be, for example, at a radial position R1 that is at the radial outside than the radially outer surface of the plate-shaped part 123, as long as an effect of reducing stiffness of the outer circumferential sidewall 120 described below is obtained. Alternatively, the radially innermost portion of the rear hook slit 121*s* may be, for example, at a radial position R2 that is at the radial inside than the radially outer surface of the plate-shaped part 123, to further reduce the stiffness.

Here, when the radially innermost portion of the rear hook slit 121*s* is set at the radial inside than the radially outer surface of the plate-shaped part 123, area forming the rear hook slit 121*s* up to the radial position R2 should not reach the rear protruding part 124 of the plate-shaped part 123, because if the radially outer surface of the rear protruding part 124, which forms the seal portion with the shroud segment 14, is missed, the intermediate chamber 18 will be connected to a downstream portion of the blade effective part of the working fluid flow path 15.

Next, regarding the front hook 122, similarly, two front hook slits 122*s* as the slits are formed in the axial direction, as illustrated in FIG. 2. A depth in the radial direction of each front hook slit 122*s* reaches the same radial position RO as the radially outer surface of the plate-shaped part 123, as illustrated in FIG. 3. The number and depth of front hook slits 122*s* are the same as those of the rear hook slits 121*s* formed at the rear hook 121 described above.

The rear hook slit 121*s* of the rear hook 121 formed as described above is to penetrate the seal portion formed together with the casing rear hook 21 between the cooling medium space 126 and the intermediate chamber 18 as illustrated in FIG. 3 above. Also, the front hook slit 122*s* of the front hook 122 will penetrate the seal portion formed together with the casing front hook 22 between the cooling medium space 126 and the working fluid flow path 15.

Such defect of the seal portion will cause the cooling medium to flow into the working fluid side, which will reduce turbine efficiency. Therefore, the seal member is attached to ensure sealing performance against the defect of the seal portions caused by the slits, that is, the rear hook slits 121*s* and front hook slits 122*s*, penetrating these seal portions. The seal member connects part or all of the slit-formed range of the hook and the sealing surface of the casing to seal the space inside and outside the hook.

During assembly of the gas turbine 10, the seal member may be temporarily fixed by, for example, adhesives, and the like that volatilize at high temperature. Alternatively, the seal member may be fixed by point welding or the like.

A configuration of the seal member of each slit is explained below.

First, the seal members of the rear hook 121 are explained.

Figure 5:
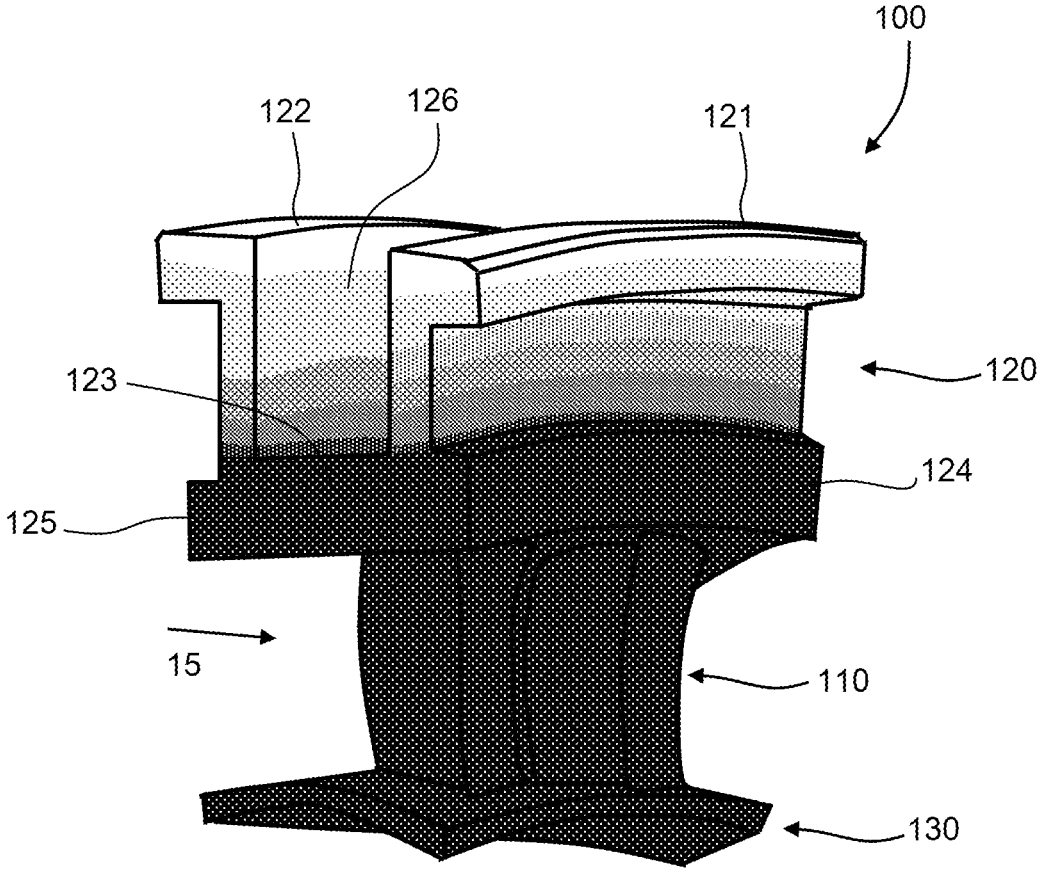
FIG. 5 is a perspective view schematically illustrating an example of temperature distribution for explaining an effect of the turbine stator blade according to the first embodiment.

As illustrated in FIG. 2, FIG. 4, and FIG. 5, a plate-shaped first seal plate 121*m* and a plate-shaped second seal plate 121*n* are provided as the seal members of the rear hook slit 121*s* that is the slit of the rear hook 121. For the attachment of the plate-shaped first seal plate 121*m* and second seal plate 121*n*, a rectangular first insertion hole 121*f* and a rectangular second insertion hole 121*h* are each formed at the rear hook 121. The first seal plate 121*m* and the second seal plate 121*n* are made of a material having a coefficient of thermal expansion equal to or substantially the same as that of the material of the rear hook 121. As a result, the first insertion hole 121*f* and the second insertion hole 121*h* can be made to be minimum dimensions in width and thickness directions into which the first seal plate 121*m* and the second seal plate 121*n* can be inserted, respectively.

As illustrated in FIG. 4, the first seal plate 121*m* extends in the width direction (in the circumferential direction) on both sides of the rear hook slit 121*s* so as to block the rear hook slit 121*s*, and in a longitudinal direction, extends in the radial direction from the radially outer surface of the rear hook wall part 121*a* to a bottom portion at the radial inside, that is, to the same radial position as the plate-shaped part radially outer surface 123*a*.

As illustrated in FIG. 2, the second seal plate 121*n* extends in the axial direction almost parallel to the plate-shaped part radially outer surface 123*a*. That is, the second seal plate 121*n* extends in the width direction (in the circumferential direction) on both sides of the rear hook slit 121*s* so as to block the rear hook slit 121*s* in the width direction, and in the longitudinal direction, extends in the axial direction from the rear side surface of the rear hook protruding part 121*c* to a front side, that is, toward a direction of the cooling medium space 126, to a position that is in contact with the first seal plate 121*m*. A radial position of the second seal plate 121*n* is a position within a range where the rear side surface of the rear hook protruding part 121*c* and the rear sealing surface 21*s* (FIG. 3) at the radial outside of the casing rear hook 21 (FIG. 3) are in close contact to form the seal portion at a circumferential position where the rear hook slit 121*s* is not formed.

In FIG. 2 to FIG. 4, the case when a width of the second seal plate 121*n* is smaller than a width of the first seal plate 121*m* is illustrated as an example for convenience of illustration, but these may be the same as each other, or conversely, the width of the first seal plate 121*m* may be smaller than the width of the second seal plate 121*n*.

By providing the first seal plate 121*m* and the second seal plate 121*n* as described above, the entire second seal plate 121*n* and a radially inner portion of the first seal plate 121*m* from a position that is in contact with the second seal plate 121*n* range from the rear sealing surface 21*s* (FIG. 3) at the radial outside of the casing rear hook 21 to the plate-shaped part radially outer surface 123*a*, to separate the cooling medium space 126 from the intermediate chamber 18 as illustrated in FIG. 3. As a result, the sealing performance can be ensured for the defect of the seal portion due to the rear hook slit 121*s* penetrating the rear hook 121.

Next, the seal members of the front hook 122 will be explained.

As illustrated in FIG. 2 and FIG. 3, a rectangular plate-shaped first seal plate 122*m* and a plate-shaped second seal plate 122*n* are provided as the seal members for the front hook slit 122*s* that is the slit of the front hook 122. A first insertion hole 122*f* and a second insertion hole 122*h* are respectively formed at the front hook 122, for setting of the first seal plate 122*m* and the second seal plate 122*n*.

The first seal plate 122*m* and the second seal plate 122*n* are made of a material having a coefficient of thermal expansion equal to or substantially the same as that of a material of the front hook 122. As a result, the first insertion hole 122*f* and the second insertion hole 122*h* can be made to be minimum dimensions in width and thickness directions into which the first seal plate 122*m* and the second seal plate 122*n* can be inserted, respectively.

As illustrated in FIG. 2 and FIG. 3, the first seal plate 122*m* extends in the width direction (circumferential direction) on both sides of the front hook slit 122*s* to block the front hook slit 122*s*, and in the longitudinal direction, extends in the radial direction from the radially outer surface of the front hook wall part 122*a* to a bottom portion at the radial inside of the front hook slit 122*s*, that is, to the same radial position as the plate-shaped part radially outer surface 123*a*.

The second seal plate 122*n* has an angle against the plate-shaped part radially outer surface 123*a* and extends toward the radial outside as it goes rearward (downstream side). That is, the second seal plate 122*n* extends in the width direction (circumferential direction) on both sides of the front hook slit 122*s* to block the front hook slit 122*s* in the width direction, and in the longitudinal direction, extends from the radially inner surface of the front hook protruding part 122*c* to a position that is in contact with the first seal plate 122*m*. A position in the axial direction of the second seal plate 122*n* is a position within a range where the radially inner surface of the front hook protruding part 122*c* and the front sealing surface 22*s* (FIG. 3) of the casing front hook 22 (FIG. 3) are in close contact to form the seal portion at a circumferential position where the front hook slit 122*s* is not formed.

In FIG. 2 and other figures, the case when a width of the second seal plate 122*n* is smaller than a width of the first seal plate 122*m* is illustrated as an example for convenience of illustration, but these may be the same as each other or, conversely, the width of the first seal plate 122*m* may be smaller than the width of the second seal plate 122*n*.

By providing the first seal plate 122*m* and the second seal plate 122*n* as described above, the entire second seal plate 122*n* and a portion of the first seal plate 122*m* from a position that is in contact with the second seal plate 122*n* to the same radial position as the plate-shaped part radially outer surface 123*a* range from the casing front hook 22 to the plate-shaped part radially outer surface 123*a*, to separate the cooling medium space 126 from the working fluid flow path 15 as illustrated in FIG. 3. As a result, it is possible to ensure the sealing performance for the defect of the seal portion due to the front hook slit 122*s* penetrating the front hook 122.

Next, actions of the turbine stator blade 100 according to this embodiment will be explained.

FIG. 5 is a perspective view schematically illustrating an example of temperature distribution for explaining effects of the turbine stator blade 100 according to the first embodiment. In FIG. 5, the darker the color, the higher the temperature.

The blade effective part 110 placed in the working fluid flow path 15 and the inner circumferential sidewall 130 facing the working fluid flow path 15 are in the highest temperature region. Regarding the outer circumferential sidewall 120, the plate-shaped part 123, the rear protruding part 124, and the front protruding part 125 are in the highest temperature region.

The temperatures of the rear hook 121 and the front hook 122 of the outer circumferential sidewall 120 generally decrease toward the radial outside due to cooling effect of the cooling medium in the cooling medium space 126.

Figure 6:
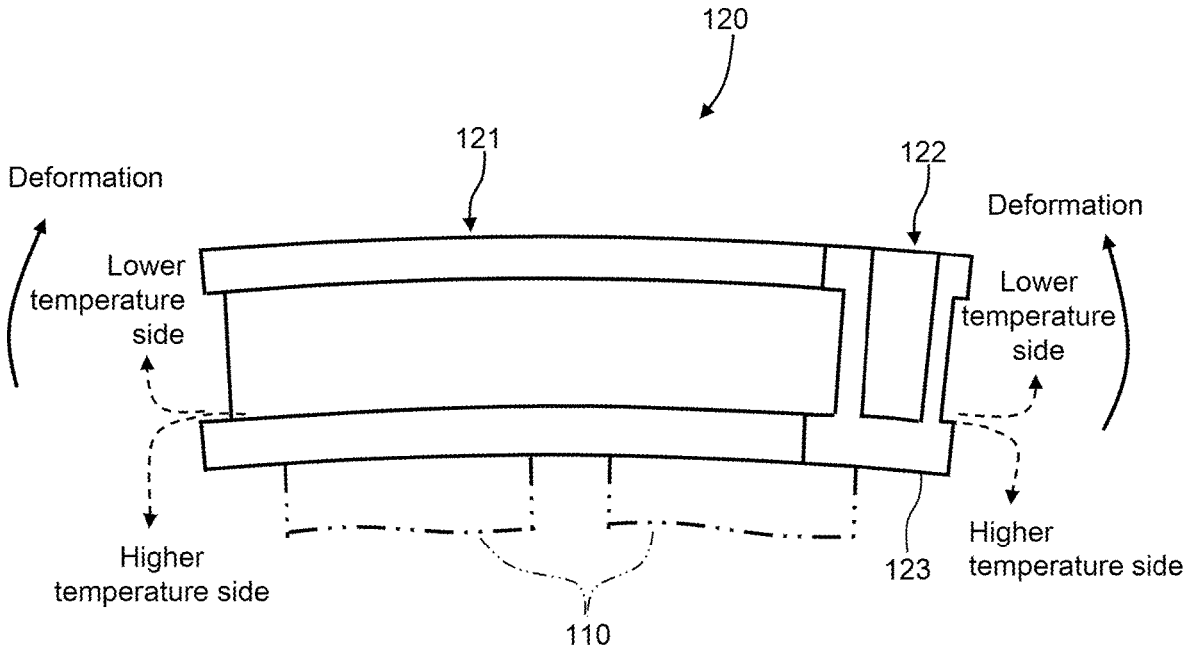
FIG. 6 is a perspective view schematically illustrating deformation due to the example of the temperature distribution for explaining the effect of the turbine stator blade according to the first embodiment.

FIG. 6 is a perspective view schematically illustrating deformation due to the example of the temperature distribution for explaining the effect of the turbine stator blade according to the first embodiment. The slits are not illustrated in FIG. 6.

Since a radial inside portion of the outer circumferential sidewall 120 is in higher temperature and a radial outside portion is in lower temperature, the thermal expansion of the radial inside portion of the outer circumferential sidewall 120 is larger than that of the radial outside portion. As a result, a circumferential shape of the outer circumferential sidewall 120 deforms in a direction where the radial inside opens.

Due to the deformation of the outer circumferential sidewall 120 as illustrated in FIG. 6, a tensile load is generated, especially at a connection portion of the blade effective part 110 with the outer circumferential sidewall 120.

As for stress due to this load, tensile stress due to the tensile load is especially high at a rear edge of the blade effective part 110 because a cross-section of the blade effective part 110 is thinner at the rear edge. A fact that an axial position of the rear edge is close to an axial position of the rear hook 121 also contributes to this tendency.

A degree of deformation of the outer circumferential sidewall 120 depends on a relative relationship between stiffness G1 of the outer circumferential sidewall 120 and stiffness G2 of the blade effective part 110 and the inner circumferential sidewall 130. That is, when magnitude of the stiffness G1 is sufficiently large compared to the stiffness G2 and the stiffness G2 is negligible, the outer circumferential sidewall 120 will deform close to free deformation due to the thermal expansion. Conversely, when magnitude of the stiffness G2 is relatively large, the outer circumferential sidewall 120 will be constrained by the blade effective part 110 and inner circumferential sidewall 130, and its deformation amount will be reduced.

In the turbine stator blade 100 of this embodiment, the rear hook slit 121*s* of the rear hook 121 and the front hook slit 122*s* of the front hook 122 are formed at the outer circumferential sidewall 120. As a result, the stiffness G1 of the outer circumferential sidewall 120 decreases, and the deformation amount of the outer circumferential sidewall 120 decreases. As a result, an effect of lowering the tensile stress at the connection portion of the blade effective part 110 with the outer circumferential sidewall 120 can be obtained.

This effect will be shown by contrasting examples of deformed states of the outer circumferential sidewall without the slit and with the slit formed.

Figure 7:
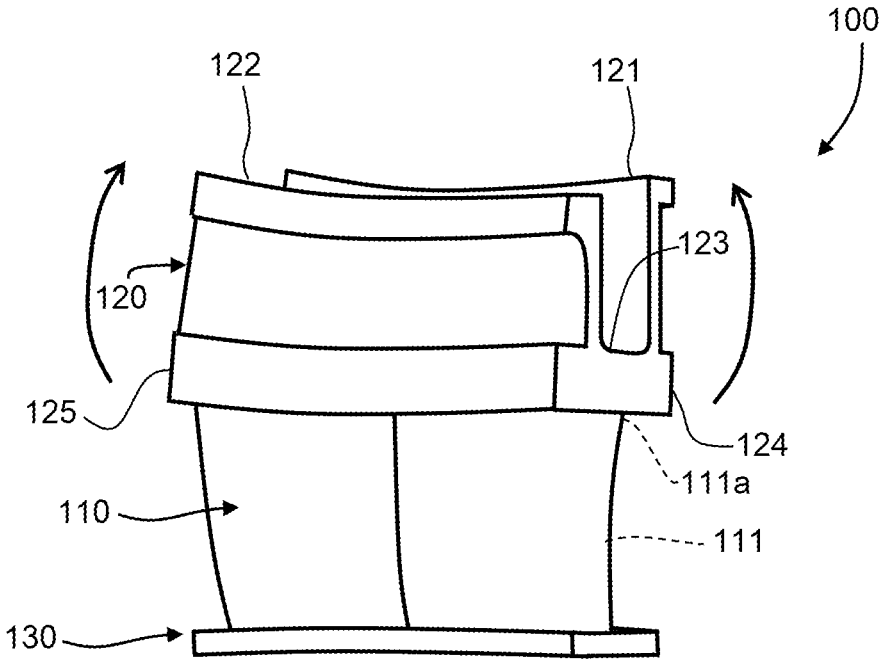
FIG. 7 is a perspective view schematically illustrating an example of a deformed state of an outer circumferential sidewall with no slit formed for explaining the effect of the turbine stator blade according to the first embodiment.
Figure 8:
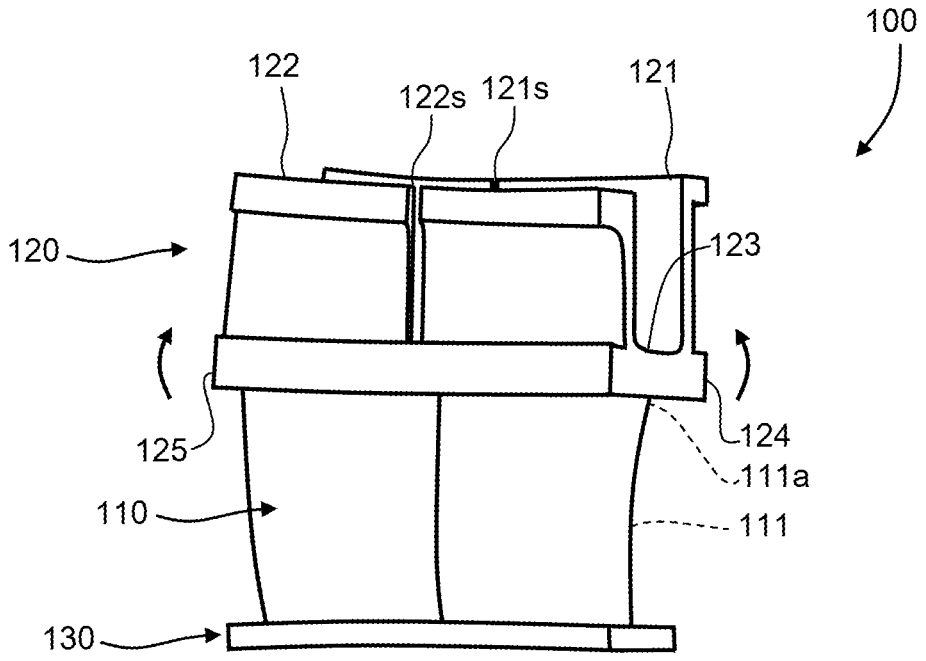
FIG. 8 is a perspective view schematically illustrating an example of a deformed state of the outer circumferential sidewall with slits formed for explaining the effect of the turbine stator blade according to the first embodiment.

FIG. 7 is a perspective view schematically illustrating an example of the deformed state of the outer circumferential sidewall with no slit formed. FIG. 8 is a perspective view schematically illustrating an example of the deformed state of the outer circumferential sidewall 120 with the slit formed. FIG. 8 illustrates an example of the case when the rear hook 121 and the front hook 122 of the outer circumferential sidewall 120 have one rear hook slit 121*s* and one front hook slit 122*s*, respectively.

When the rear hook slit 121*s* and front hook slit 122*s* illustrated in FIG. 8 are formed, each stiffness of the rear hook 121 and the front hook 122 of the outer circumferential sidewall 120 decreases, which reduces the deformation in the direction where the radial inside of the outer circumferential sidewall 120 opens, compared to the case illustrated in FIG. 7 where these slits are not formed.

As a result, stress at a portion of high stress, such as near a blade effective part rear edge outer root part 111*a*, which is a connection portion of a blade effective part rear edge 111 of the blade effective part 110 with the outer circumferential sidewall 120, is particularly reduced.

As explained above, since the stress at the blade effective part rear edge outer root part 111*a* is high, the effect of the rear hook slit 121*s* formed at the rear hook 121 is particularly significant, and depending on a stress level, the slit may be formed only at the rear hook 121. Furthermore, depending on relative positions, shapes, and dimensions of the members in the turbine stator blade 100, the slit may be formed only at one of the rear hook and the front hook as long as the stress in the turbine stator blade 100 is effectively reduced.

As mentioned above, the turbine stator blade 100 according to this embodiment can reduce the stress near the connection portion of the blade effective part 110 with the outer circumferential sidewall 120 by forming the slit, thereby ensuring the soundness of the turbine stator blade 100. Besides, even after the formation of the slit, the sealing performance is ensured, which prevents the cooling medium from flowing into the working fluid side, thereby preventing a decrease in the turbine efficiency.

Second Embodiment

This embodiment is a modification of the first embodiment.

The first embodiment is a case where, regarding the rear hook 121, the seal portion between the cooling medium space 126 and the intermediate chamber 18 is formed at the contact portion between the rear side surface of the rear hook protruding part 121*c* and the rear sealing surface 21*s* at the radial outside of the casing rear hook 21.

On the other hand, the second embodiment is a case where the seal portion between the cooling medium space 126 and the intermediate chamber 18 is formed at a contact portion between the radially outer surface of the rear hook protruding part 121*c* and a rear sealing surface 21*v* at the radial outside of the casing rear hook 21. The second embodiment can be applied to the case where such a state is formed.

In addition to the rear sealing surface 21*v*, the rear sealing surface 21*s* may be formed as in the first embodiment.

A force that pushes the turbine stator blade 100 to the downstream side due to a differential pressure in front and behind the turbine stator blade 100 may result in formation of the rear sealing surface 21*s* and deformation of the outer circumferential sidewall 120 such that the rear sealing surface 21*s* is formed.

The second embodiment differs in a configuration of the seal portion of the rear hook slit 121*s* as the seal member and is otherwise the same as the first embodiment. The following description is made with reference to FIG. 9 to FIG. 11.

Figure 9:
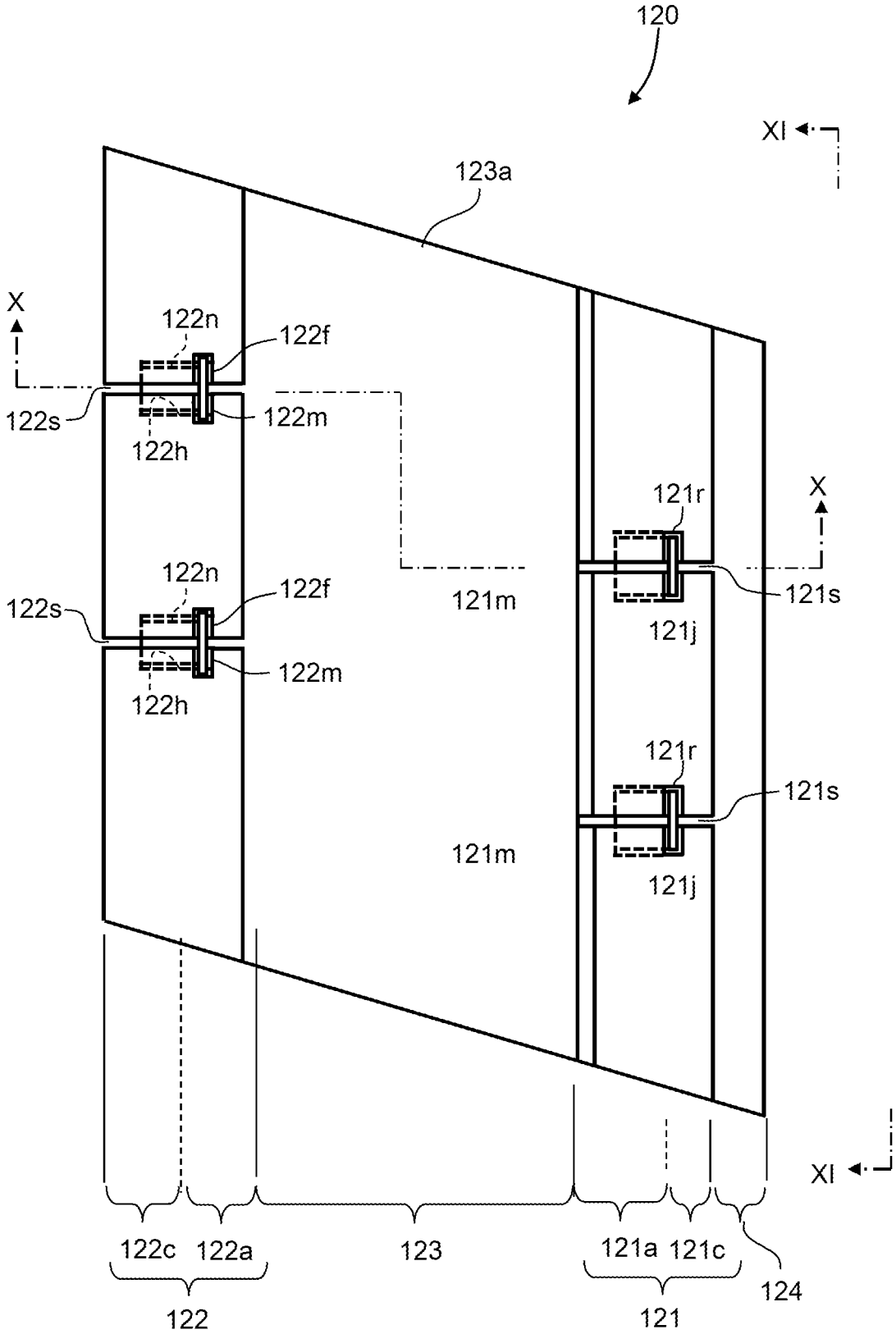
FIG. 9 is a plan view of a turbine stator blade according to a second embodiment, viewed from the radial outside.
Figure 10:
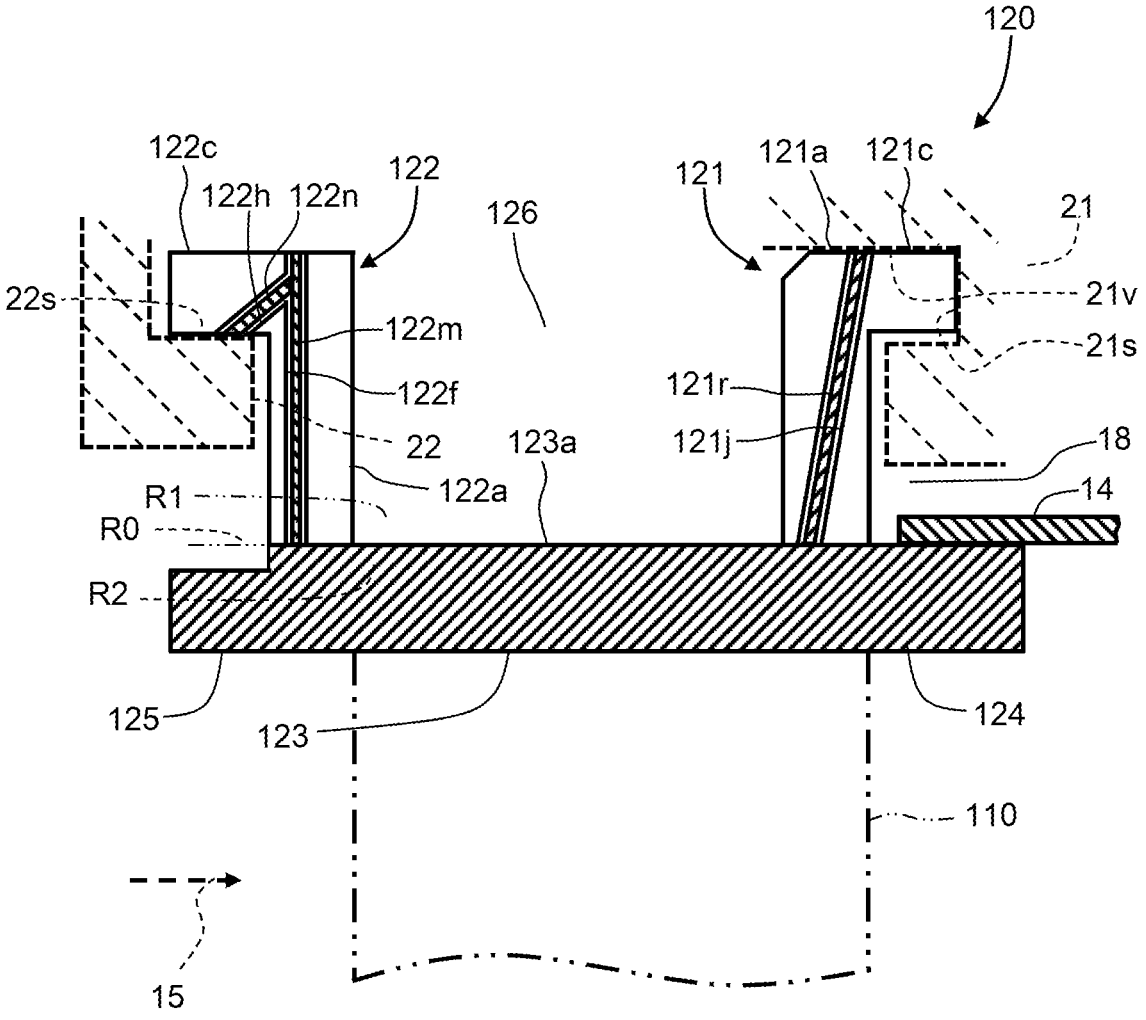
FIG. 10 is a sectional arrow view illustrating the turbine stator blade according to the second embodiment, taken along a line X-X in FIG. 9.
Figure 11:
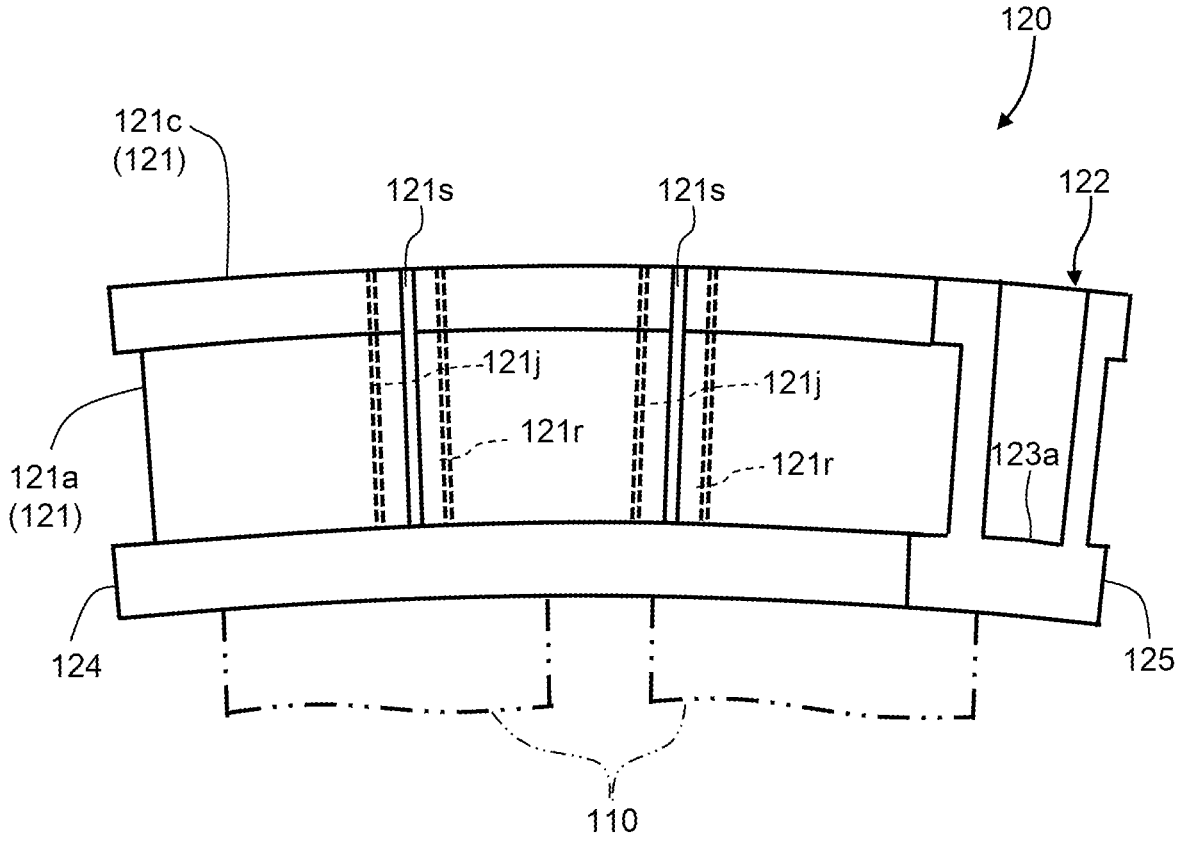
FIG. 11 is a front arrow view illustrating the turbine stator blade according to the second embodiment, taken along a line XI-XI in FIG. 9.

FIG. 9 is a plan view of the turbine stator blade 100 according to the second embodiment viewed from the radial outside, FIG. 10 is a sectional arrow view taken along a line X-X in FIG. 9, and FIG. 11 is a front arrow view taken along a line XI-XI in FIG. 9.

As the seal member in this embodiment, a single oblique seal plate 121*r* is provided instead of the first seal plate 121*m* and the second seal plate 121*n* in the first embodiment. For this purpose, an oblique insertion hole 121*j* is formed at the rear hook 121.

The oblique seal plate 121*r* extends in the width direction (circumferential direction) on both sides of the rear hook slit 121*s* to block the rear hook slit 121*s* in the width direction. In the longitudinal direction, as illustrated in FIG. 10, the oblique seal plate 121*r* extends radially inward and obliquely from a surface position of a portion where the radially outer surface of the rear hook protruding part 121*c* of the rear hook 121 faces the rear sealing surface 21*v* at the radial outside of the casing rear hook 21 to the bottom portion at the radial inside of the rear hook slit 121*s*, that is, to the same radial position as the radial position of the plate-shaped part radially outer surface 123*a*.

One end surface in the longitudinal direction of the oblique seal plate 121*r* may be finished parallel to a surface of a portion where the rear hook protruding part 121*c* of the rear hook 121 faces the rear sealing surface 21*v* (FIG. 10). The other end surface in the longitudinal direction of the oblique seal plate 121*r* may be finished parallel to the plate-shaped part radially outer surface 123*a*. This allows a contact area to be maximized at both ends in the longitudinal direction of the oblique seal plate 121*r* by surface contact, thereby improving the sealing performance.

When the outer circumferential sidewall 120 is shaped and dimensioned such that the oblique seal plate 121*r* can be provided to range from a portion of the rear hook protruding part 121*c* of the rear hook 121 that is in contact with the rear sealing surface 21*s* to the plate-shaped part radially outer surface 123*a*, the oblique seal plate 121*r* may be set in this manner.

As mentioned above, by providing only the oblique seal plate 121*r*, the oblique seal plate 121*r* ranges between the casing rear hook 21 and the plate-shaped part radially outer surface 123*a*, and the cooling medium space 126 can be separated from the intermediate chamber 18. As a result, the sealing performance can be ensured for the defect of the seal portion due to the rear hook slit 121*s* penetrating the rear hook 121.

Other Embodiments

While certain embodiments have been described, these embodiments have been presented by way of example only, and are not intended to limit the scope of the inventions. Indeed, those embodiments may be embodied in a variety of other forms; furthermore, various omissions, substitutions, and changes in the form of the embodiments described herein may be made without departing from the spirit of the inventions. Embodiments and modifications thereof are included in the scope and gist of the invention as well as in the scope of the claims and their equivalents.

What is claimed is:

1. A turbine stator blade disposed in a working fluid flow path in a casing of a gas turbine, the turbine stator blade comprising:

a blade effective part disposed in the working fluid flow path;

an outer circumferential sidewall including a plate-shaped part that is connected to a radially outer end portion of the blade effective part, and hooks each extending radially outward and circumferentially from the plate-shaped part and having a tip engaged with the casing; and an inner circumferential sidewall connected to a radially inner end portion of the blade effective part; wherein at least one slit is formed at at least one of the hooks to divide the at least one of the hooks in a circumferential direction, and the at least one of the hooks has a seal member to seal the slit, wherein the hooks include a front hook extending radially outward and circumferentially from an upstream end side of the plate-shaped part, and a rear hook extending radially outward and circumferentially from a downstream end side of the plate-shaped part, the slit is formed at the rear hook, and the seal member includes:

a rear hook first seal plate in a plate shape extending on both sides of the slit to block the slit, in a width direction thereof, and extending in a radial direction from a radially outer surface of a rear hook wall part of the rear hook to a radial position of a bottom portion of the slit, in a longitudinal direction thereof; and a rear hook second seal plate extending on both sides of the slit to block the slit, in the width direction thereof, and extending in an axial direction from a rear side surface of a rear hook protruding part of the rear hook toward an upstream direction to a position that is in contact with the rear hook first seal plate, in the longitudinal direction thereof.

2. The turbine stator blade according to claim 1, wherein the slit is formed at the front hook, and the seal members include:

a front hook first seal plate extending on both sides of the slit to block the slit, in the width direction thereof, and extending in the radial direction from a radially outer surface of the front hook to a radial position of a bottom portion of the slit, in the longitudinal direction thereof; and a front hook second seal plate extending on both sides of the slit to block the slit in the width direction thereof, and extending from a radially inner surface of a protruding part formed at the front hook to a position that is in contact with the front hook first seal plate, in the longitudinal direction thereof.

3. The turbine stator blade according to claim 1, wherein the position of the bottom portion of the slit is the same radial position as that of the radially outer surface of the plate-shaped part.

4. A turbine stator blade disposed in a working fluid flow path in a casing of a gas turbine, the turbine stator blade comprising:

a blade effective part disposed in the working fluid flow path;

an outer circumferential sidewall including a plate-shaped part that is connected to a radially outer end portion of the blade effective part, and hooks each extending radially outward and circumferentially from the plate-shaped part and having a tip engaged with the casing; and an inner circumferential sidewall connected to a radially inner end portion of the blade effective part; wherein at least one slit is formed at at least one of the hooks to divide the at least one of the hooks in a circumferential direction, and the at least one of the hooks has a seal member to seal the slit, wherein the hooks include a front hook extending radially outward and circumferentially from an upstream end side of the plate-shaped part, and a rear hook extending radially outward and circumferentially from a downstream end side of the plate-shaped part, the slit is formed at the rear hook, and the seal member includes an oblique seal plate extending radially inward and obliquely from a radially outer surface of the rear hook to a radial position of a bottom portion of the slit, and extending on both sides of the slit to block the slit in the width direction thereof.

5. The turbine stator blade according to claim 4, wherein the slit is formed at the front hook, and the seal members include:

a front hook first seal plate extending on both sides of the slit to block the slit, in the width direction thereof, and extending in the radial direction from a radially outer surface of the front hook to a radial position of a bottom portion of the slit, in the longitudinal direction thereof; and a front hook second seal plate extending on both sides of the slit to block the slit in the width direction thereof, and extending from a radially inner surface of a protruding part formed at the front hook to a position that is in contact with the front hook first seal plate, in the longitudinal direction thereof.

6. The turbine stator blade according to claim 4, wherein the position of the bottom portion of the slit is the same radial position as that of the radially outer surface of the plate-shaped part.

* * * * *